United States Patent [19]

Franchi et al.

[11] 4,399,628

[45] Aug. 23, 1983

[54] FIRING MECHANISM FOR FIREARMS

[75] Inventors: Gianfranco Franchi, Monticelli Brusati; Giovanni Gamba, Gardone V.T., both of Italy

[73] Assignee: Le Armerie Italiane F.LLI Gamba S.n.c., Italy

[21] Appl. No.: 221,379

[22] Filed: Dec. 30, 1980

[30] Foreign Application Priority Data

Oct. 29, 1980 [IT] Italy ..... 5232 A/80

[51] Int. Cl.[3] ..... F41C 19/00

[52] U.S. Cl. ..... 42/42 R; 42/69 R

[58] Field of Search ..... 42/42 R, 42 A, 41

[56] References Cited

U.S. PATENT DOCUMENTS

| | | | |
|---|---|---|---|
| 1,870,552 | 8/1932 | Browning | 42/42 R |
| 2,033,803 | 3/1936 | Anderson | 42/41 |
| 2,095,525 | 10/1937 | Mariano | 42/42 R |
| 2,203,378 | 6/1940 | Browning | 42/42 R |
| 3,903,631 | 9/1975 | Vesamaa | 42/41 X |

*Primary Examiner*—Charles T. Jordan
*Assistant Examiner*—Ted L. Parr
*Attorney, Agent, or Firm*—McGlew and Tuttle

[57] ABSTRACT

A double barrel shotgun having a pair of hammers is provided with a tripping rod and a safety lever that respectively engage an arming tooth and a safety tooth formed on each hammer. The tripping rod and safety lever are in two different planes so as to be separately displaced and concurrently controlled by two steps formed on a balancing lever that is pivotally coupled to the trigger or triggers of the shotgun.

7 Claims, 6 Drawing Figures

FIRING MECHANISM FOR FIREARMS

FIELD OF THE INVENTION

The present invention relates to tripping and firing mechanisms for firearms in general, that is for rifles, shotguns, guns with double barrels that are over-and-under or side-by-side and with one or two triggers.

BACKGROUND OF THE INVENTION

Several arrangements are already known in the field of tripping and firing mechanisms. Among them, are the mechanisms of the "Holland" variety with a hammer, associated with which are a tripping rod and a safety lever. The rod and lever are generally mounted side-by-side and are provided with terminal appendices that are concurrently engaged by the trigger when the hammer is disengaged.

However, with such or similar arrangement it is not possible to employ a selecting device, so as to determine at will, in the case of a firearm with a single trigger, the selective disengagement of the hammer first to the left and subsequently to the right, or vice versa. Such selectivity becomes possible only through the employment of very complicated arrangements that are, furthermore, cumbersome and hard to set in motion.

Also known is an arrangement, similar to the above which, in order to allow the employment of a firing selector, is provided with a tripping rod that is actuated by the trigger and which, in turn, actuates the safety lever when the hammer is disengaged. However, this second arrangement does not allow a tripping operation which is both safe and light as required by a first class firearm.

In addition, none of the known arrangements provide at all for the block-wise and manual disassembly of the firing mechanism from the form housing, so that there are serious limitations with respect to the practicality, adaptability, versatility and maintenance of the known arrangements.

BRIEF SUMMARY OF THE INVENTION

It is, therefore, an object of the present invention to provide an improved firing mechanism for shotguns with a double barrel, i.e. with two hammers. The gun is easily disassembled block-wise and manually, from the housing and allows easy employment of a selector device for choosing the disengagement of the left and then the right hammer, or vice versa. This selector device enables the engagement of each hammer by attaching it in its upper portion so as to have a lighter mounting and tripping operation. There is, furthermore, provided a tripping rod and a safety lever, independent of each other and separately controlled, even if concurrently. All of the component members or elements of the mechanism are mounted on a preferably monoblocked support.

THE DRAWINGS

Details and more particular descriptions of the embodiments of the present invention will become apparent from the following description and from the accompanying illustrative drawings which do not limit in the least the scope of the invention.

DETAILED DESCRIPTION OF THE INVENTION

Figure 1:
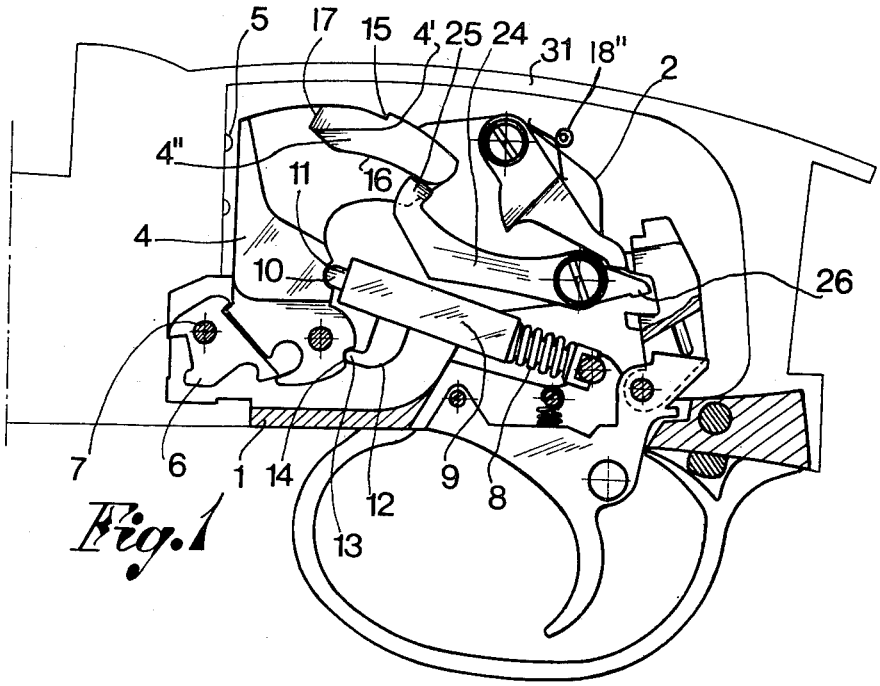
FIG. 1 is a fragmentary side elevational view, partially in section, of the firing mechanism of the present invention, mounted on the housing and with the hammer of the firearm in a disengaged position.

Referring now to the accompanying drawings, the underguard 1 is provided in its intermediate area with a vertical plate-like central partition which constitutes, preferably, although not necessarily, an integral unit with the underguard member 1. Two firing or striking hammers 4 are positioned, one on each side of the central partition 2, and are mounted on a common pivot 3 in the underguard 1. The hammers 4 are in juxtaposition with respective firing pins 5 for the two barrels of the firearm and are placed either in an over-under or a side-by-side relationship. To the lower, frontal portion of each hammer 4 there is coupled an arming lever 6 that is mounted on the underguard 1 by a pivot pin 7 and actuated by the mechanism (not shown because it is conventionally known) which determines the arming of the hammers 4 when the barrels of the gun are opened. On the opposite side, each hammer 4 is actuated by a respective pressure spring 8 through a respective tubular member 9 each of which has a terminal projection 10 lodged within a seat 11 provided in the rear part of the respective hammer 4. Each tubular member 9 has, furthermore, a lower stem 12 with another terminal element for engaging a second seat 14 of each hammer 4. This engagement causes the return movement of the hammer 4 to its original position after having been disengaged.

In accordance with the present invention, on top of each hammer 4 there is an arcuate member 4' (FIG. 1) which has an upwardly directed arming tooth 15 and a disarming element 4''. The disarming element 4'' comprises a cammed step or surface 16 and, at the forward extremity thereof, includes a safety tooth 17 (FIG. 2).

Figure 3:
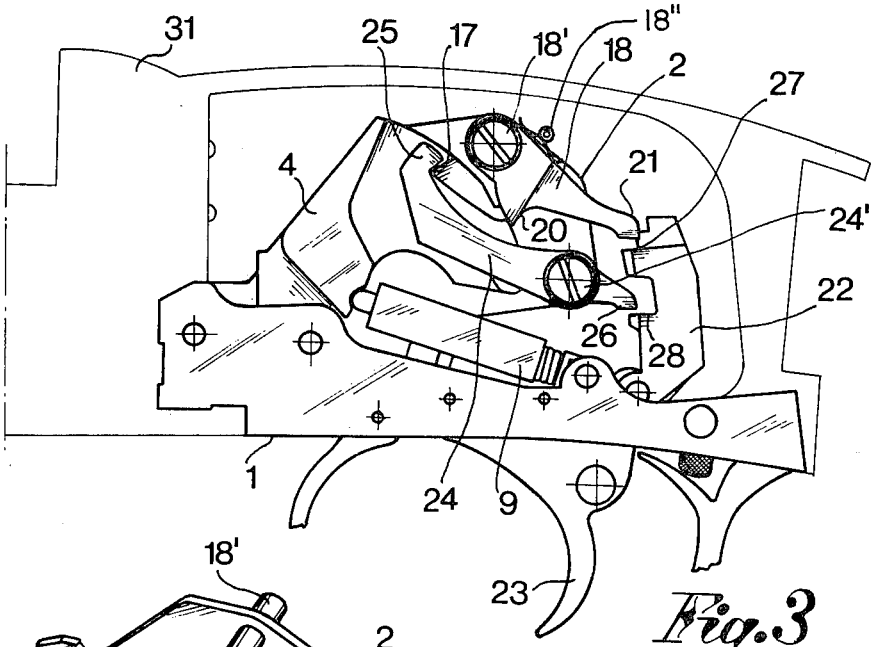

As shown in FIG. 3, a tripping rod 18 is associated with each hammer 4 by means of a pivot pin 18' that is mounted on the upper portion of the partition 2. The rod 18 has, in its lower part, an arresting projection 20 which engages the arming tooth 15 of the hammer 4 and, in its rear part, an extremity 21 which cooperates with a balancing lever 22. The lever 22 is connected to and displaceable with the trigger 23 of the mechanism. The rod 18 is also actuated by a spring 18'' which serves to keep the rod 18 displaced downwardly.

Figure 5:
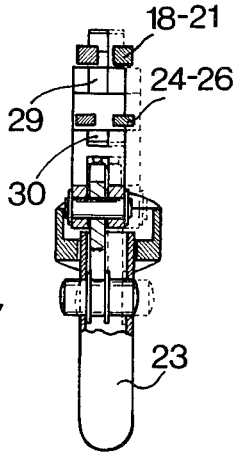
FIG. 5 is a sectional elevational view taken along line V—V of FIG. 4.
Figure 4:
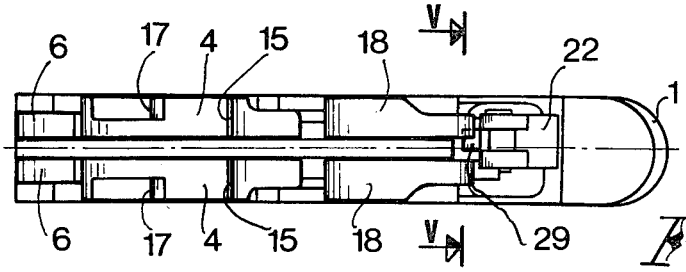
FIG. 4 is a top plan view of the mechanism shown in FIG. 1.

Finally, there is coordinated with each hammer 4 a safety lever 24 which is oscillatingly pivoted by means of a pin 24' mounted in the partition 2, so as to be in a plane different from that of the tripping rod 18 (FIG. 5). The safety lever 24 has, in its frontal region extending into element 4'' of each hammer 4, a projection 25 for engaging the safety tooth 17 of the hammer, so as to arrest the tooth 17 in the safety position in the event of failure in the arresting operation or of accidental engagement of the hammer 4 on the part of the rod 18. To the rear extremity of the safety lever 24 there is a terminal 26 which cooperates with the balancing lever 22 that is pivotally coupled to the trigger 23.

The safety lever 24 is, in turn, actuated by a spring, not shown, which upwardly displaces the frontal extremity of the safety lever 24, so as to insure, when needed, the engagement of the projection 25 with safety tooth 17 and also to insure the contact of the frontal extremity of the safety lever 24 with the cammed surface 16, the surface positioning the lever 24 in a neutral position disengaged from the balancing lever 22.

It is to be observed that the balancing lever 22 may be of the "fixed-position" type for the disengagement first of one hammer and them of the other, in accordance with a pre-established and unchangeable sequence. On the other hand, the balancing lever 22 may be of the "regulatable-position" type that is conventionally known, thus constituting the so-called "selector", by means of which it becomes possible to disengage the right hand hammer 4 prior to the left hand one, or vice versa, and this without losing the required conditions of functionality and safety of the mechanism.

In any event, however, the balancing lever 22 has at different height levels two stair-steps 27 and 28 (FIG. 3) for engagement with the rear extremities of the tripping rod 18 and, respectively with the safety lever 24, when the hammer 4 is disengaged. In the case of a balancing lever 22 with a selective function, the lever has, besides the steps 27 and 28, two tabs 29 and 30 (FIG. 5) which allows the control of the rod 18 and of the lever 22 correspondent to that hammer that has to be disengaged first.

The tripping rod 18 and its safety lever 24 are, in any event, displaced separately from each other, although they are concurrently controlled. The balancing lever 22 displaces them, thus insuring their correct action upon and with respect to the respective hammer 4.

The above-described mechanism is applied as a block to the housing 31 of the weapon, retaining the ability of disassembly as a block.

Figure 2:
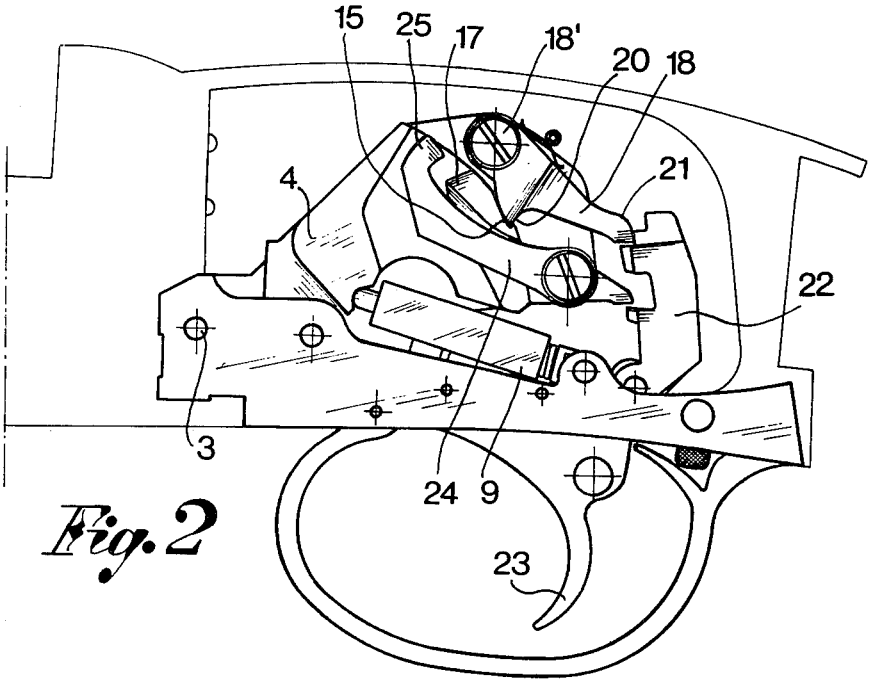
FIGS. 2 and 3 are fragmentary side elevational views corresponding to that of FIG. 1, but with the hammer in the armed position and, respectively, in the safety position.

In FIG. 1 of the drawings there is shown the mechanism with the hammer 4 disengaged. It is possible to appreciate in this figure the shape of the hammer 4, the positioning of the tripping rod 18 and of the safety lever 24 (both with respect to each other and to the hammer 4) and, in particular the action of the cammed surface or step 16 of the hammer 4 on the safety lever 24 for the placement of the latter in a neutral position (disengagement with respect to the balancing lever 22) when the hammer is disengaged.

FIG. 2 shows the hammer 4 in the armed position. This position is insured by the engagement of the projection 20 of the tripping rod 18 with the arming tooth 15 of the hammer 4. It can also be seen in FIG. 2 that the front projection 25 of the safety lever 24 protrudes even when detached from the safety tooth 17 of the hammer 4, so as to be ready to intervene and arrest the hammer 4 in the event of accidental disengagement thereof. The rear extremities of the tripping rod 18 and of the lever 24 are, in turn, associated with the respective steps 27 and 28 of the balancing lever 22 to be concurrently actuated for the disengagement of the hammer 4.

FIG. 3 shows the arresting of the hammer 4, in position of safety on the part of the projection 25 of the safety lever 24 and in cooperation with the tooth 17, in the case of missed arming of an uncontrolled disengagement of the hammer 4.

It is understood that it is possible to bring modifications and variances to the above described mechanical arrangement without departing from the scope of the present invention.

Thus for example, the central vertical partition 2, rather than being an integral part of the underguard 1, could be a separately made member to be attached to the underguard 1.

Figure 6:
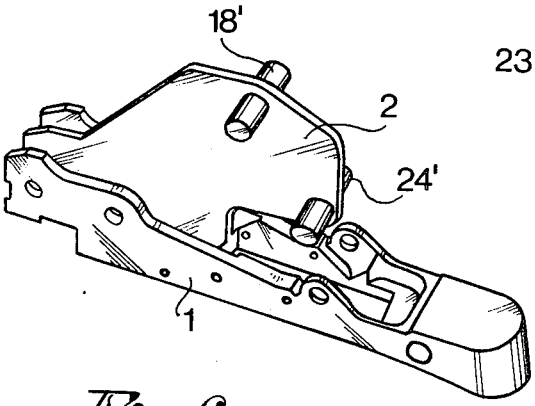
FIG. 6 is a perspective view of the underguard with a central wall-plate shown in FIG. 1.

Further, pivots 18' and 24' of the rod 18 and, respectively, of the lever 24 could be made as an integral part of the partition 2, as shown by FIG. 6, or they could be made separate and then attached.

Finally, rather than one trigger, as shown in the drawings, the mechanism may have two triggers without altering the functionality and the safety of the firearm and without requiring the positioning of a balancing lever 22 having a selective firing function.

I claim:

1. A tripping and firing mechanism for use with a double-barrel shotgun having a housing and firing pins comprising: an underguard coupled with the shotgun housing; two hammers mounted on pivot means in said underguard and associated with the firing pins of the double-barrel shotgun; each of the hammers having, at an upper part thereof, an arming tooth and a safety tooth; two arming levers for arming said hammers upon opening of the barrels of the shotgun; two pressure springs acting on said hammers to displace them toward the firing pins; and at least one trigger connected to a trigger actuated balancing lever having a pair of steps each at a different height for controlling the disengagement of said hammers in either a fixed or in a variable sequence; a tripping rod and a safety lever cooperating with each of said hammers and arranged to engage the respective arming tooth and safety tooth provided in the upper part of each hammer, said tripping rod and safety lever of each hammer engageable with respective ones of said pair of steps provided on said balancing lever; said tripping rod and safety lever of each hammer being in two different planes and being separately, even if concurrently, controlled by said balancing lever.

2. The mechanism according to claim 1 wherein said hammers are mounted on a common pivot.

3. The mechanism according to claim 1, wherein said tripping rod and safety lever of each hammer pivotally mounted on a plate-like, vertical partition.

4. The mechanism according to claim 3 wherein said partition is integral with said underguard.

5. The mechanism according to claim 1 wherein each hammer has an arcuate portion on its top including an arming tooth for engagement with an arresting projection provided on said tripping rod for arresting said hammer in the armed position, and wherein on a side of said hammer there is a disarming member along which extends said safety lever, said disarming member defining said safety tooth for engagement with an end projection on said safety lever.

6. The mechanism according to claim 5, wherein said disarming member of said hammer further comprises a surface cooperating with said safety lever for displacing and keeping said safety lever in a neutral position of disengagement with respect to said balancing lever when said hammer is disengaged.

7. The mechanism according to claim 1, wherein said tripping rod and said safety lever for each hammer has a rear extremity, said rear extremity of said tripping rod being spaced in height with respect to said rear extremity of said safety lever with each extremity cooperating with respective ones of said steps of said balancing lever; said tripping rod and said safety lever being actuated by respective springs for keeping said extremities displaced toward said steps of said balancing lever.

* * * * *